US009323281B2

(12) United States Patent
Byun et al.

(10) Patent No.: US 9,323,281 B2
(45) Date of Patent: Apr. 26, 2016

(54) PEDAL ASSEMBLY FOR VEHICLE

(71) Applicant: Kyung Chang Industrial Co., Ltd., Daegu (KR)

(72) Inventors: Sungil Byun, Daegu (KR); Dongjin Jeon, Daegu (KR)

(73) Assignee: Kyung Chang Industrial Co., Ltd., Daegu (KR)

( * ) Notice: Subject to any disclaimer, the term of this patent is extended or adjusted under 35 U.S.C. 154(b) by 0 days.

(21) Appl. No.: 14/174,408

(22) Filed: Feb. 6, 2014

(65) Prior Publication Data

US 2015/0033903 A1 Feb. 5, 2015

(30) Foreign Application Priority Data

Aug. 5, 2013 (KR) ..... 10-2013-0092331

(51) Int. Cl.
*G05G 1/44* (2008.04)
*G05G 5/03* (2008.04)

(52) U.S. Cl.
CPC .. *G05G 1/44* (2013.01); *G05G 5/03* (2013.01); *Y10T 74/20534* (2015.01)

(58) Field of Classification Search
CPC ..... Y10T 74/20534
USPC ..... 74/512–514, 560; 701/70
See application file for complete search history.

(56) References Cited

U.S. PATENT DOCUMENTS

| | | | | |
|---|---|---|---|---|
| 7,793,566 | B2 * | 9/2010 | Ypma | G05G 1/38 74/513 |
| 8,434,385 | B2 * | 5/2013 | Mo | G05G 1/506 74/512 |
| 2004/0065167 | A1 * | 4/2004 | Kim | G05G 1/30 74/560 |
| 2004/0237700 | A1 * | 12/2004 | Wurn | 74/514 |
| 2007/0157755 | A1 * | 7/2007 | Kim et al. | 74/513 |
| 2007/0193401 | A1 * | 8/2007 | Campbell | 74/560 |
| 2008/0147287 | A1 * | 6/2008 | Park et al. | 701/70 |
| 2010/0319480 | A1 * | 12/2010 | Nebuya et al. | 74/513 |

FOREIGN PATENT DOCUMENTS

| | | |
|---|---|---|
| EP | 1 273 989 B1 | 11/2007 |
| JP | 2013-14250 | 1/2013 |
| KR | 20-1995-0006069 | 3/1995 |

(Continued)

OTHER PUBLICATIONS

Machine translation of KR 10-2011-0050848, Lee et al., May 2011.*

(Continued)

*Primary Examiner* — Vinh Luong
(74) *Attorney, Agent, or Firm* — Mintz Levin Cohn Ferris Glovsky and Popeo, P.C.; Kongsik Kim; Carolina Säve

(57) ABSTRACT

A pedal assembly for a vehicle is provided and includes a housing and a pedal part that is rotatably coupled to the housing. A movable member has an inclined surface formed on one side thereof and slidably moves with respect to the housing. A connection member moves in cooperative operation with the rotation of the pedal part. Additionally, a friction member is connected to the connection member and slidably moves along the inclined surface of the movable member in the state of being brought into contact with the inclined surface and an elastic member is located between the other side of the movable member and the housing.

10 Claims, 4 Drawing Sheets

(56) References Cited

FOREIGN PATENT DOCUMENTS

| | | |
|---|---|---|
| KR | 10-2010-0094778 | 8/2010 |
| KR | 10-2011-0050848 | 5/2011 |

OTHER PUBLICATIONS

Machine translation of KR 10-2010-0094778, Choi et al., Aug. 2010.*

* cited by examiner

PEDAL ASSEMBLY FOR VEHICLE

CROSS-REFERENCE TO RELATED APPLICATIONS

This application claims priority to Korean Application No. 10-2013-0092331 filed on Aug. 5, 2013, which is incorporated herein by reference.

TECHNICAL FIELD

The present invention relates to a pedal assembly for a vehicle, and more particularly, to an organ-type accelerator pedal assembly for a vehicle.

RELATED ART

An accelerator pedal is located on the lower end portion of a driver's seat of a vehicle, through which the driving speed of the vehicle is controlled by the driver. If the driver steps on the accelerator pedal, a pedal force, with which the driver recognizes that the accelerator pedal is manipulated, should be generated. In this case, a pedal assembly has to generate hysteresis from which the generation of the pedal force is recognized.

Such hysteresis generation system has been disclosed in European Patent Publication No. EP 1 273 989 B1 (published on Nov. 28, 2007), wherein a friction member has friction against a rounded surface, thereby generating hysteresis therefrom, and a force with which a pedal part is pressed is transmitted from members having a chain structure. According to the conventional structure, however, the transmission of the force is not conducted easily due to the unexpected relative rotation of the members having the chain structure, and since the friction member has friction against the rounded surface, further, it is not easy to manufacture a device for precisely controlling the frictional force generated therebetween.

SUMMARY

Accordingly, the present invention has been made in view of the above-mentioned problems occurring in the prior art, and it is an object of the present invention to provide a pedal assembly for a vehicle that is capable of easily transmitting a force by which a pedal part is pressed and easily controlling the generation of hysteresis.

To accomplish the above object, according to the present invention, there is provided a pedal assembly for a vehicle including: a housing; a pedal part rotatably coupled to the housing; a movable member having an inclined surface formed on one side thereof and slidably moving with respect to the housing; a connection member moving in cooperative operation with the rotation of the pedal part; a friction member connected to the connection member and slidably moving along the inclined surface of the movable member in the state of being brought into contact with the inclined surface; and an elastic member located between the other side of the movable member and the housing.

According to the present invention, desirably, the movable member has a rail formed on the inclined surface, and the friction member has legs inserted into the rail in such a manner as to be slidably moved along the rail.

According to the present invention, desirably, the rail is formed open outwardly from the top side of the inclined surface, and the legs are in a form of one pair open outwardly in correspondence with the shape of the rail.

According to the present invention, desirably, the friction member includes: a body contacted with the top side of the inclined surface, to which the legs are connected; and a cylindrical shaft extended from the body in such a manner as to be connected rotatably to the connection member.

According to the present invention, desirably, the connection member has a groove formed on the end portion thereof, to which the cylindrical shaft of the friction member is fitted.

According to the present invention, desirably, the pedal assembly further includes a first shock-absorbing member adapted to be contacted with any one of the connection member and the friction member when the pedal part is at an initial state and a second shock-absorbing member adapted to be contacted with the pedal part when the pedal part is at a maximum operating state.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION

Hereinafter, an explanation on a pedal assembly for a vehicle according to the present invention will be in detail given with reference to the attached drawing. It should be understood that the preferred embodiment of the present invention is just illustrative and not limited thereto. Also, the present invention relates to an organ-type accelerator pedal, but the scope of the present invention is not necessarily restricted thereto. That is, it should be apparently understood that the present invention is applicable to all pedal assemblies for a vehicle.

Figure 1:
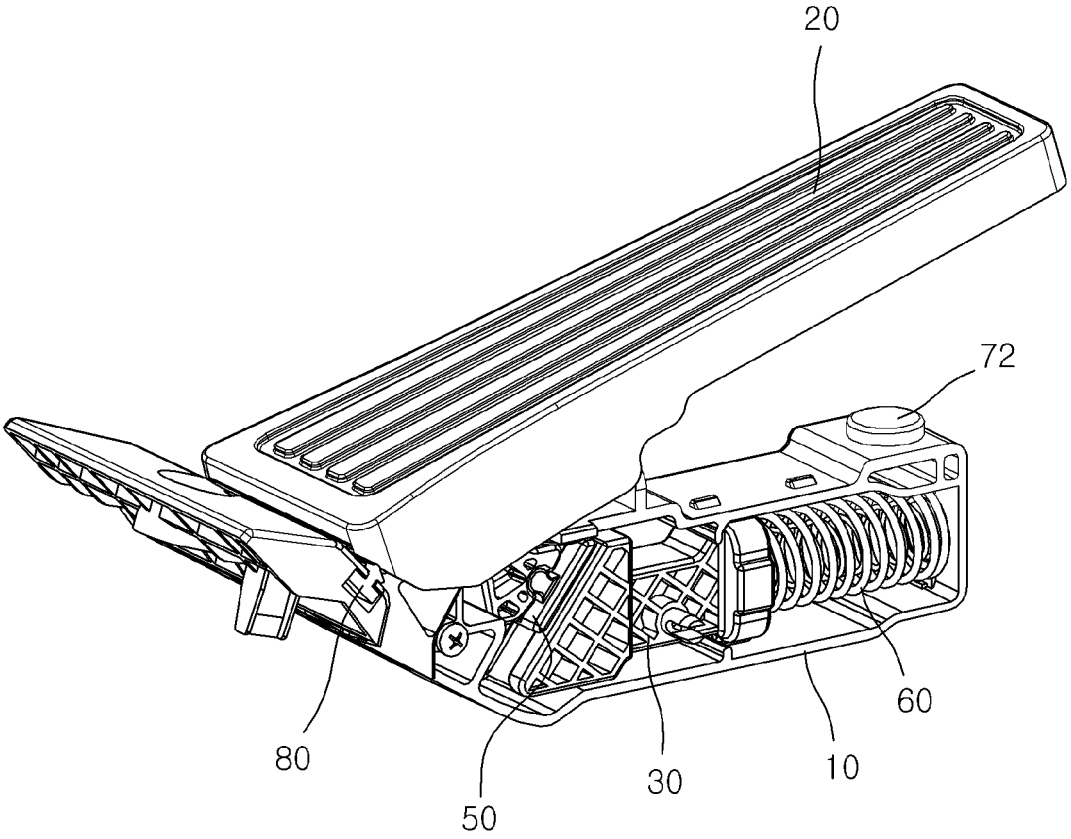
FIG. 1 is a perspective view showing a pedal assembly for a vehicle according to the present invention.
Figure 2:
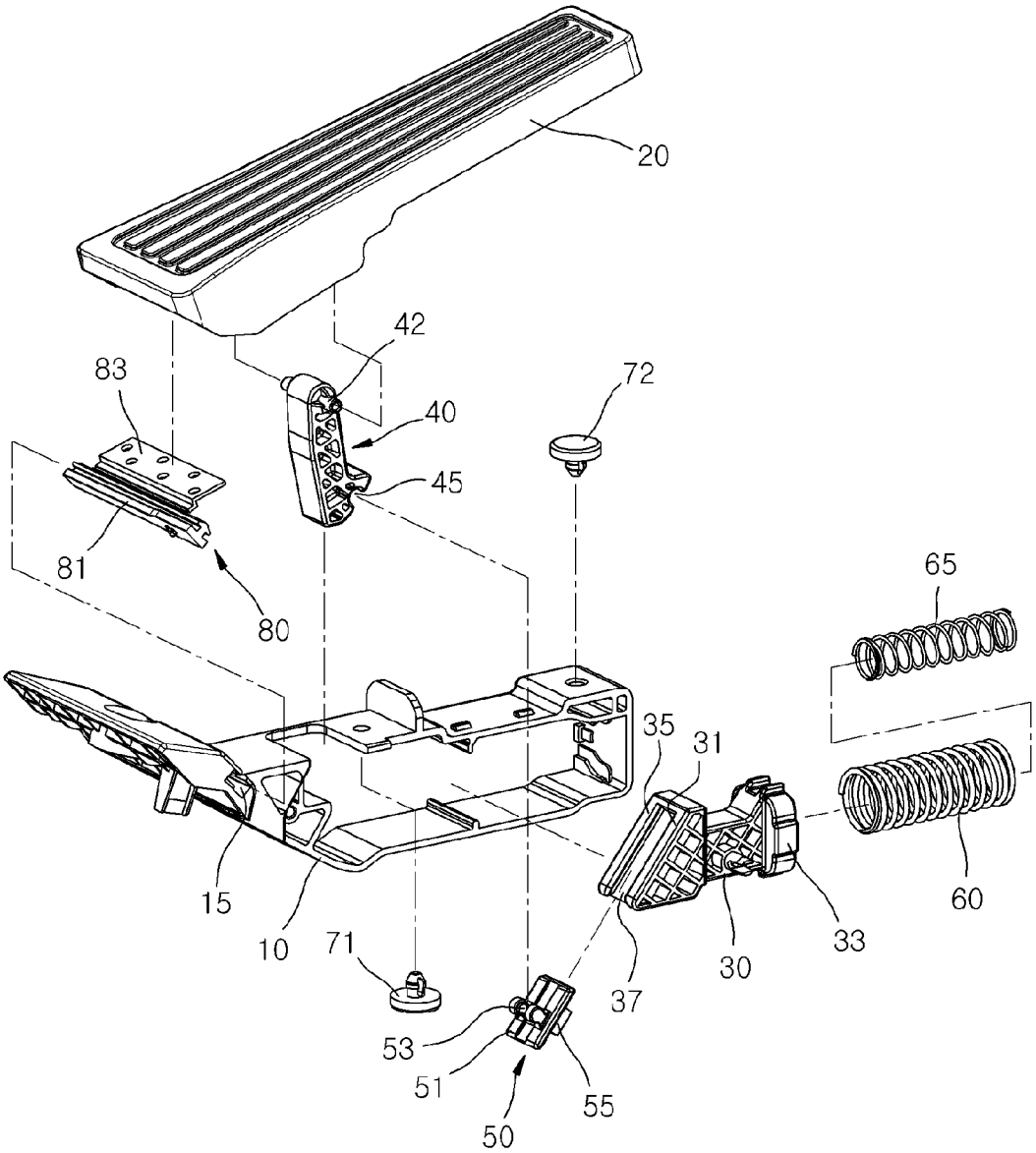
FIG. 2 is an exploded perspective view showing the pedal assembly for a vehicle according to the present invention.

FIG. 1 is a perspective view showing a pedal assembly for a vehicle according to the present invention, and FIG. 2 is an exploded perspective view showing the pedal assembly for a vehicle according to the present invention. For the brevity of illustration, parts like a cover for covering a housing and a printed circuit board, which are not related to the technological scope and functions of the present invention, will be not illustrated in the drawing.

As shown in FIGS. 1 and 2, a pedal assembly for a vehicle according to the present invention includes a housing 10, a pedal part 20 rotatably coupled to the housing 10, a movable member 30, a connection member 40 rotating in cooperative operation with the rotation of the pedal part 20, a friction member 50 and an elastic member 60.

The pedal part 20 is rotated around a rotary shaft part 80 located at one side of the housing 10. The rotary shaft part 80 includes a base 81 and a rotary member 83 connected rotatably to the base 81. The base 81 of the rotary shaft part 80 is fixedly fitted to a fastening groove 15 formed on the housing 10.

Figure 4:
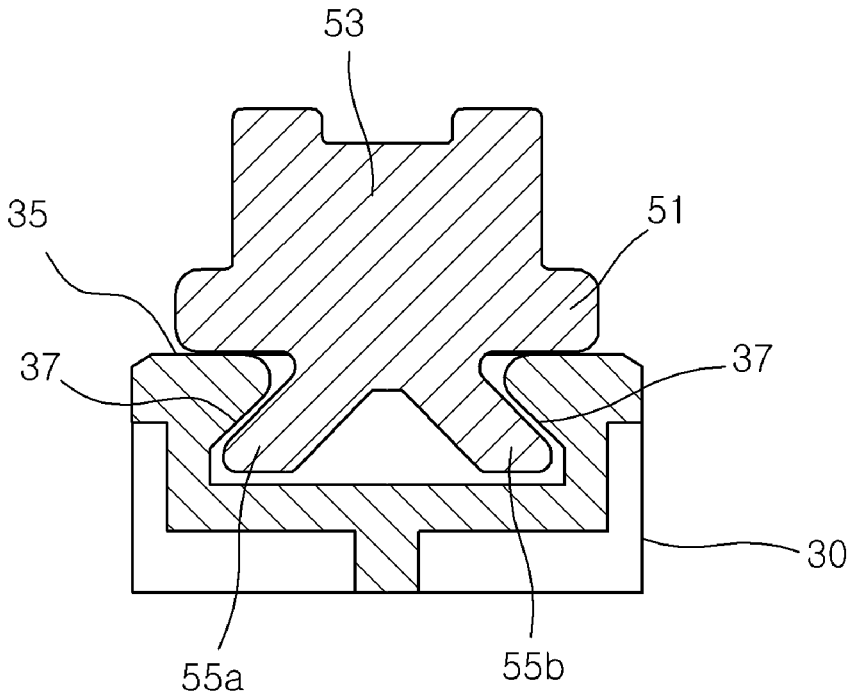
FIG. 4 is a sectional view showing a portion of a friction member and a movable member in the pedal assembly for a vehicle according to the present invention.

The movable member 30 has an inclined surface 35 formed on one side thereof and slidably moves with respect to the housing 10. The movable member 30 has a rail 37 formed on the inclined surface 35. As shown in FIG. 4, the rail 37 is formed open outwardly from the top side of the inclined surface 35.

The connection member 40 is rotatably connected to the pedal part 20 through a shaft 42, and if the pedal part 20 is pressed and rotated around the rotary shaft part 80, the connection member 40 is movable in cooperative operation with the pedal part 20. The connection member 40 has a groove 45 formed thereon, to which a cylindrical shaft 53 of the friction member 50 as will be discussed later is fitted.

The friction member 50 is connected to the connection member 40 and slidably moves along the inclined surface 35 of the movable member 30 in the state of being brought into contact with the inclined surface 35. The friction member 50 includes a body 51 contacted with the top side of the inclined surface 35, the cylindrical shaft 53 extended from the body 51 in such a manner as to be connected rotatably to the connection member 40, and a pair of legs 55*a* and 55*b* inserted into the rail 37 in such a manner as to be slidably moved along the rail 37. The legs 55*a* and 55*b* are extended from the opposite surface of the body 51 to one surface of the body 51 to which the cylindrical shaft 53 is connected. The cylindrical shaft 53 is fitted to the groove 45 of the connection member 40 in such a manner as to be somewhat rotatable. As shown in FIG. 4, the legs 55*a* and 55*b* are desirably open outwardly in correspondence with the shape of the rail 37. Such formation of the rail 37 and the legs 55*a* and 55*b* prevents the legs 55*a* and 55*b* from being escaped from the rail 37. Such escape prevention structure is not limited to the above-mentioned shapes of the rail 37 and the legs 55*a* and 55*b*, which is just illustrative.

The elastic member 60 is located between the other side 33 of the movable member 30 and the housing 10. So as to enhance an elastic force, a second elastic member 65 may be further provided.

Further, the pedal assembly for a vehicle according to the present invention includes a first shock-absorbing member 71 adapted to be contacted with any one of the connection member 40 and the friction member 50 when the pedal part 20 is not pressed and a second shock-absorbing member 72 adapted to be contacted with the pedal part 20 when the pedal part 20 is fully pressed. The first shock-absorbing member 71 and the second shock-absorbing member 50 are desirably made of a rubber material and have the functions as a stopper.

Next, an explanation on the operation of the pedal assembly for a vehicle according to the present invention will be given.

Figure 3:
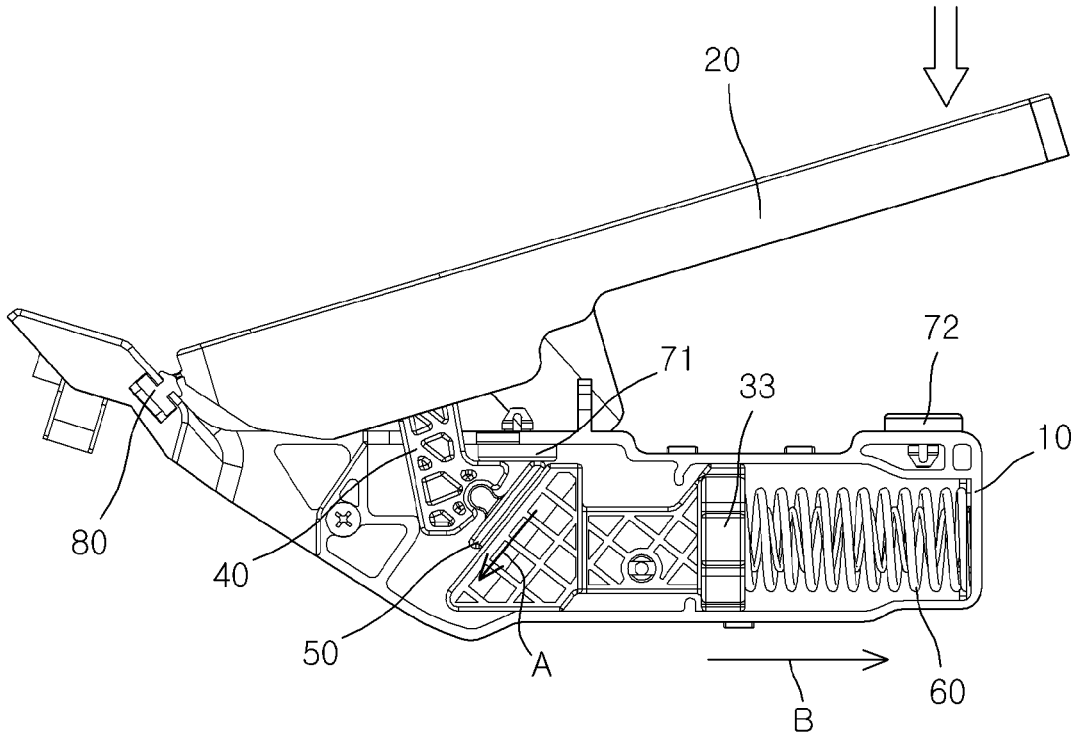
FIG. 3 is a side view showing the pedal assembly for a vehicle according to the present invention.

If the pedal part 30 is pressed by a driver in the direction of an arrow as shown in FIG. 3 so as to increase the driving speed, the connection member 40 moves in the same direction as the direction of the pedal being pressed. Accordingly, the friction member 50 connected to the connection member 40 frictionally slides along the inclined surface 35 of the movable member 30 in the direction of A as shown in FIG. 3. Next, the movable member 30 slides in the direction of B as shown in FIG. 3, and the elastic member 60 becomes compressed. Through the generation of the frictional force between the friction member 50 and the movable member 30, a pedal force is transmitted to the driver, and if the driver's foot is separated from the pedal part 20 or a pressing force against the pedal part 20 is decreased, the pedal part 20 is returned to its initial position through the restoring force of the elastic member 60.

As mentioned above, the pedal assembly for a vehicle according to the present invention is capable of accurately transmitting a force of pressing the pedal part and also performing the generation of hysteresis with a simple configuration.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A pedal assembly for a vehicle comprising:

a housing;

a pedal part rotatably coupled to the housing;

a movable member having an inclined surface formed on one side thereof and slidably moving with respect to the housing;

a connection member moving in cooperative operation with the rotation of the pedal part;

a friction member connected to the connection member and slidably moving along the inclined surface of the movable member in the state of being brought into contact with the inclined surface; and an elastic member located between the other side of the movable member and the housing, wherein the movable member has a rail formed on the inclined surface and extending along a longitudinal direction of the inclined surface, and the friction member has legs inserted into the rail in such a manner as to be slidably moved along the rail.

2. The pedal assembly for a vehicle according to claim 1, wherein the rail is formed open outwardly from the top side of the inclined surface, and the legs are in a form of one pair open outwardly in correspondence with the shape of the rail.

3. The pedal assembly for a vehicle according to claim 2, further comprising a first shock-absorbing member adapted to be contacted with any one of the connection member and the friction member when the pedal part is not pressed.

4. The pedal assembly for a vehicle according to claim 3, further comprising a second shock-absorbing member adapted to be contacted with the pedal part when the pedal part is fully pressed.

5. The pedal assembly for a vehicle according to claim 1, wherein the friction member comprises:

a body contacted with the top side of the inclined surface, to which the legs are connected; and a cylindrical shaft extended from the body in such a manner as to be connected rotatably to the connection member.

6. The pedal assembly for a vehicle according to claim 5, wherein the connection member has a groove formed on the end portion thereof, to which the cylindrical shaft of the friction member is fitted.

7. The pedal assembly for a vehicle according to claim 1, further comprising a first shock-absorbing member adapted to be contacted with any one of the connection member and the friction member when the pedal part is not pressed.

8. The pedal assembly for a vehicle according to claim 7, further comprising a second shock-absorbing member adapted to be contacted with the pedal part when the pedal part is fully pressed.

9. The pedal assembly for a vehicle according to claim 1, further comprising a first shock-absorbing member adapted to be contacted with any one of the connection member and the friction member when the pedal part is not pressed.

10. The pedal assembly for a vehicle according to claim 9, further comprising a second shock-absorbing member adapted to be contacted with the pedal part when the pedal part is fully pressed.

* * * * *